US007761944B2

(12) United States Patent
Skophammer

(10) Patent No.: US 7,761,944 B2
(45) Date of Patent: Jul. 27, 2010

(54) BABY CHANGING DUFFEL

(76) Inventor: Charlotte Skophammer, HC 32 Box 3136, Kingman, AZ (US) 86409

( * ) Notice: Subject to any disclaimer, the term of this patent is extended or adjusted under 35 U.S.C. 154(b) by 0 days.

(21) Appl. No.: 11/961,972

(22) Filed: Dec. 20, 2007

(65) Prior Publication Data

US 2009/0158527 A1 Jun. 25, 2009

(51) Int. Cl.
*B68G 5/00* (2006.01)

(52) U.S. Cl. ..... 5/655; 5/420; 190/1; 190/109; 224/577

(58) Field of Classification Search ..... 5/93.2, 5/420, 485, 655, 947, 417, 482; 190/1, 2, 190/109, 901; 383/4, 25, 40; 150/6, 110; 224/577

See application file for complete search history.

(56) References Cited

U.S. PATENT DOCUMENTS

| | | | | |
|---|---|---|---|---|
| 3,489,194 | A | 1/1970 | Hoover | |
| 4,068,786 | A | 1/1978 | Taniguchi | |
| 4,154,323 | A | 5/1979 | Sneider | |
| 4,375,111 | A | 3/1983 | Hall | |
| 4,566,130 | A | 1/1986 | Coates | |
| 4,723,300 | A | 2/1988 | Aranow | |
| 4,781,277 | A | 11/1988 | Lim | |
| 4,886,150 | A | 12/1989 | Fitzsimmons | |
| 4,999,863 | A | 3/1991 | Kane | |
| 5,370,460 | A | 12/1994 | Nelson | |
| 5,615,433 | A | 4/1997 | Martin | |
| 5,692,257 | A * | 12/1997 | Albertieri | 5/655 |
| 5,813,558 | A | 9/1998 | Burke | |
| 5,926,881 | A | 7/1999 | Madison | |
| 5,961,216 | A | 10/1999 | Quinn et al. | |
| 6,053,634 | A | 4/2000 | Kay | |
| 6,390,260 | B1 | 5/2002 | Roegner | |
| 6,694,552 | B1 | 2/2004 | Vickers | |
| 7,207,426 | B2 * | 4/2007 | Godshaw et al. | 190/1 |
| 2003/0226205 | A1 * | 12/2003 | Fishman | 5/413 R |
| 2005/0028277 | A1 * | 2/2005 | Gordon et al. | 5/420 |
| 2005/0071920 | A1 * | 4/2005 | Higashi et al. | 5/417 |
| 2006/0289582 | A1 * | 12/2006 | Killilea | 224/577 |
| 2007/0122066 | A1 * | 5/2007 | Landay | 383/16 |
| 2007/0214574 | A1 * | 9/2007 | Soloway | 5/655 |

(Continued)

FOREIGN PATENT DOCUMENTS

| | | | | |
|---|---|---|---|---|
| JP | 2005224056 | * | 8/2005 | 5/655 |

*Primary Examiner*—Peter M Cuomo
*Assistant Examiner*—Brittany M Wilson
(74) *Attorney, Agent, or Firm*—David A. Belasco; Belasco Jacobs & Townsley, LLP

(57) ABSTRACT

A baby changing duffel includes a changing pad formed of resilient material, sized and shaped to serve as a changing surface for either an infant or a toddler. The pad is covered with a removable, washable cover. The cover is sized and shaped to fit over the changing pad and has an inner changing surface and an outer surface. An upper pouch is attached adjacent to an upper end of the outer surface. A retaining sleeve is attached to a lower end of the cover and encloses a folded portion of the pad and cover. The side pockets have interior compartments and are attached at the edges of the outer surface of the cover. The side pockets are folded over the inner changing surface for transport. A carrying handle extends between side edges of the cover and is located to support the duffel when folded to fit the retaining sleeve.

4 Claims, 5 Drawing Sheets

U.S. PATENT DOCUMENTS

2007/0277321 A1* 12/2007 Leach ..... 5/655
2009/0064412 A1* 3/2009 Habimana ..... 5/482
2009/0127307 A1* 5/2009 Austwick et al. ..... 224/577

* cited by examiner

BABY CHANGING DUFFEL

FIELD OF INVENTION

This invention relates to the field of infant care items, and more specifically to a compact baby changing surface that converts to a carrying bag for necessary baby changing items.

BACKGROUND OF THE INVENTION

Care of infants and very young children often requires substantial gear. Mothers that travel with their children need convenient means for transporting the equipment necessary to care for their children. This is particularly true for children still in diapers. As these children often need to be changed at inconvenient times and in inconvenient places, a device that can transport the various items necessary for changing a baby and, at the same time, provide a clean and comfortable surface upon which to change the baby is useful to the traveling mother. Various solutions to this problem have been proposed.

U.S. Pat. No. 4,886,150, issued to Fitzsimmons discloses a combination baby changing device and diaper bag. The baby accessory carrier of this invention includes an elongated, quilted, rectangular body with rounded corners. The body defines a central changing area for receiving a separate, water-impermeable change pad. The pad is attached to panel by VELCRO® hooking and looping strips. A U-shaped handle is connected to each side of the body in the area of the panel. Tie strips are also provided at the ends of the panel between the arms of the handles. A pair of large pockets are provided on the rear or bottom surface of panel 8 for carrying baby related articles. The pockets are formed by separate panels of material sewn to the body and they open outwardly towards the sides of the body. Additional pockets are provided on each end of the body and open inwardly towards panel. These pockets are maintained in a closed position by VELCRO® hooking and looping tabs on the body and on the inside surface of the pockets. In order to close the carrier into a compact package, the two pocket panels are folded inwardly into overlapping relationship with each other and with central panel. All three panels are then folded along the center so that the handles become aligned with one another for carrying purposes. The tie strips are then knotted together to secure the device in the fully closed position.

U.S. Pat. No. 4,566,130, issued to Coates is directed to a combination carrying bag and diapering station. The diapering station has three sections separated by fold lines. A strap at one end functions as a carrying handle when the changing station is folded to form a carrying bag. End section has a pocket that opens inwardly for receiving baby related articles. The opposite end section also has a number of pockets to store other infant supplies such as bottles, pacifiers, toys, etc. Two other pockets are available to store other miscellaneous flat items. Pocket is on the outer surface and could be used to hold smaller objects such as pacifiers or key rings, or some of the possessions of the mother or father. A larger pocket is a zippered pocket for storing infant bottles and food jars and it has side sleeves and optional closure flaps. The changing station is folded into a carrying bag by folding end section upwardly along line onto middle section, and then folding the center section into the end section. The bag is then maintained closed by snap fasteners.

U.S. Pat. No. 5,692,257, issued to Albertieri illustrates a combination baby blanket, bunting, and bag. The baby blanket according to this invention, spreads out for use as a changing cloth. The baby blanket can be folded into a bag. This is accomplished by folding upper section down and lower section up to substantially overlie middle section. The sections can be folded in any order. The left panel is then folded along edge portion to the right to overlie first half. The left panel and the first half are then folded along the center line to overlie the second half. A first handle can be seen connected to the free end of the right panel. In addition, a second handle is connected to the rear or outer portion of the cloth panel along the center line. The combined first half, left panel, and second half are then folded along the edge portion against the right panel. The handles are positioned close enough to each other to be grasped by one hand. The sleeve is accessible so that the baby's bottle or a similar item is readily accessible.

U.S. Pat. No. 4,723,300, issued to Aranow disclose a convertible tote bag for holding articles therein. The bag includes a front and rear panel which are connected together along their side edges by a pair of zippers. When the zippers are unzipped, the panels can be folded flat, thereby exposing a moisture absorbing pad on which a baby can be placed for diapering. The moisture absorbent pad is releasably secured to the panels. Interposed between the pad and the panels is a releasably secured moisture impervious barrier layer to protect the panels from being wet or soiled. The barrier layer and the pad can be readily removed to enable each to be cleaned. The bag also includes a pair of carrying handles and at least one exterior pocket.

U.S. Pat. No. 4,375,111, issued to Hall is directed to a convertible beach mat is provided that is lightweight, easy to fold up for transport, and bacteria-resistant. An inflatable head is connected to a body portion, and straps are associated with the corners of the head and body portions to releasably hold a towel covering the body portion alone, or both the body and head portions. The mat also is formed in combination with a carrying bag, one of the walls of the carrying bag being formed by a portion of the mat adjacent one corner of the mat. A pocket outside of the volume of the bag that contains the mat is formed with one wall of the mat for transporting accessory items.

It is an objective of the present invention to provide a convenient transport device for baby changing necessaries. It is a further objective to provide such a device that converts into a baby changing surface that is both clean and comfortable for both mother and baby. It is a still further objective of the invention to provide a transport device that is light weight, compact and easily carried. It is yet a further objective to provide a transport device that can be converted easily and quickly into the needed changing surface. Finally, it is an objective of the present invention to provide such a device that is inexpensive, attractive and easily cleaned.

While some of the objectives of the present invention are disclosed in the prior art, none of the inventions found include all of the requirements identified.

SUMMARY OF THE INVENTION

The present invention addresses all of the deficiencies of prior art baby changing duffel inventions and satisfies all of the objectives described above.

(1) A baby changing duffel may be constructed from the following components. A changing pad is provided. The pad is formed of resilient material, sized and shaped to serve as a changing surface for either an infant or a toddler. A removable, washable cover is provided. The cover is sized and shaped to fit over the changing pad and has an inner changing surface and an outer surface. An upper storage pouch is provided. The upper pouch is attached adjacent to an upper end of the outer surface. A retaining sleeve is provided. The retaining sleeve is attached adjacent to a lower end of the outer surface and is sized and shaped to enclose a folded portion of the changing pad and washable cover. At least one side pocket is provided. The side pocket has at least one interior compartment and is attached at a first edge at a side edge of the outer surface of the removable cover. The side pocket is folded over the inner changing surface for transport. A carrying handle is provided. The handle extends from a first side edge of the cover to a second side edge of the cover and located to support the duffel when folded to fit the retaining sleeve.

(2) In a variant of the invention, the inner changing surface is formed of waterproof material.

(3) In another variant, hooking and looping pads are attached to the side pocket to secure the pocket to either the inner changing surface or another side pocket.

(4) In still another variant, the retaining sleeve provides a covered opening for removing the washable cover from the changing pad.

(5) In a final variant of the invention, hooking and looping elements are added to a lower end of the outer surface of the cover and an inner portion of the retaining sleeve. The looping and hooking elements secure the lower end within the retaining sleeve.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-8 illustrate a baby changing duffel 10 that may be constructed from the following components. As illustrated in FIG. 3, changing pad 14 is provided.

The pad 14 is formed of resilient material 18, sized and shaped to serve as a changing surface 22 for either an infant or a toddler (not shown). The pad has a top surface, a bottom surface, an upper edge surface, two side edge surfaces, and a lower edge surface. A removable, washable cover 30 is provided. The cover 30 is sized and shaped to fit over the top surface, the bottom surface, the upper edge surface, and the two side edge surfaces of the changing pad 14 and has an inner changing surface 34 and an outer surface 38. The inner changing surface extends to but does not fit over said lower edge surface of said changing pad, as shown in FIG. 3. As illustrated in FIGS. 1 and 2, an upper storage pouch 42 is provided. The upper pouch 42 is attached adjacent to an upper end 46 of the outer surface 38. A retaining sleeve 50 is provided. The retaining sleeve 50 is attached adjacent to a lower end 54 of the outer surface 38 and is sized and shaped to enclose a folded portion 58 of the changing pad 14 and washable cover 30. At least one side pocket 62 is provided. The side pocket 62 has at least one interior compartment 66 and is attached at a first edge 70 at a side edge 74 of the outer surface 38 of the removable cover 30. The side pocket 62 is folded over the inner changing surface 34 for transport. As illustrated in FIGS. 1, 2 and 4, a carrying handle 78 is provided. The handle 78 extends from a first side edge 82 of the cover 30 to a second side edge 86 of the cover 30 and located to support the duffel 10 when folded to fit the retaining sleeve 50.

Figure 1:
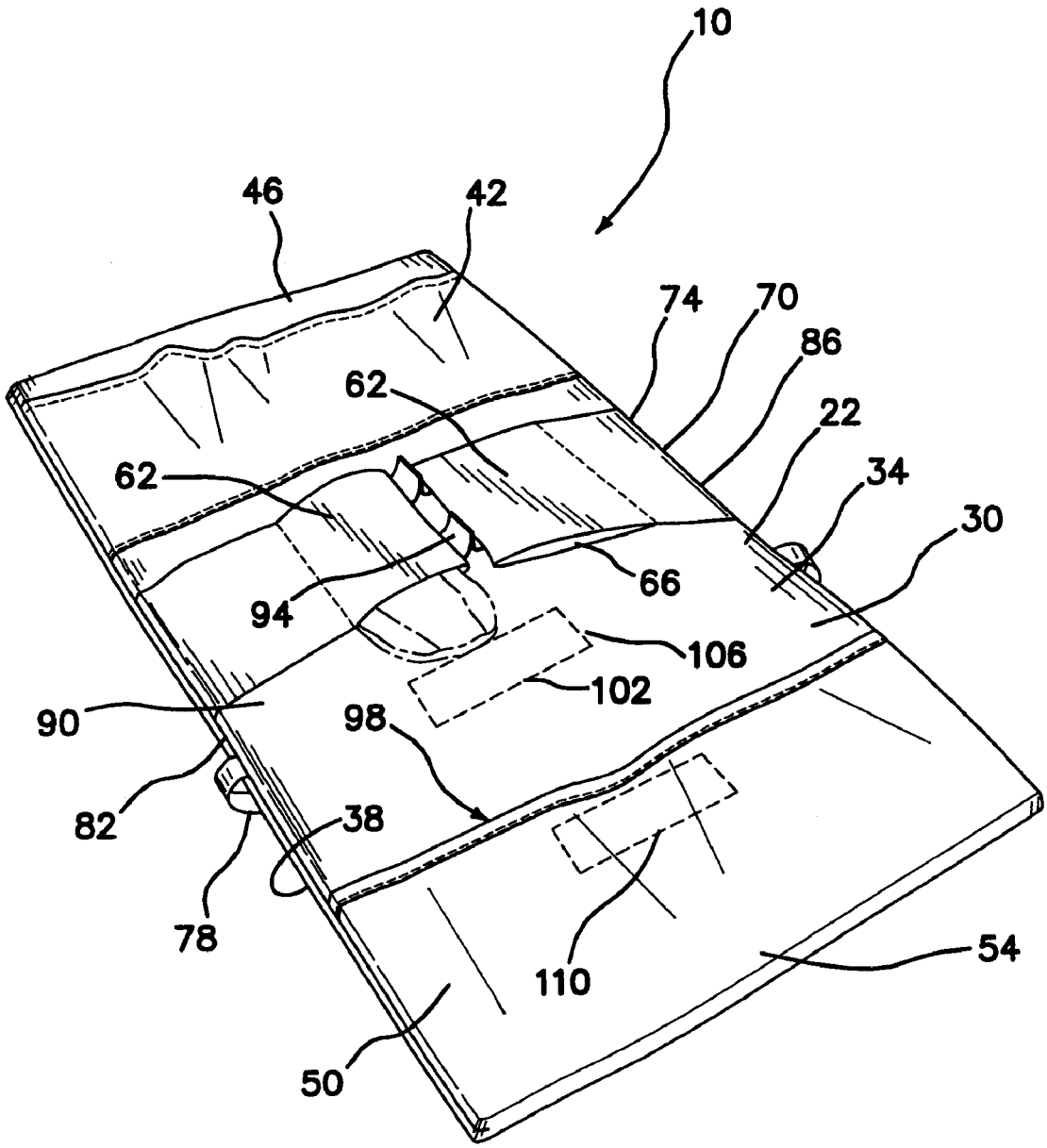
FIG. 1 is a perspective view of the preferred embodiment of the invention illustrating the inner surface of the duffel with the center pockets joined together.
Figure 2:
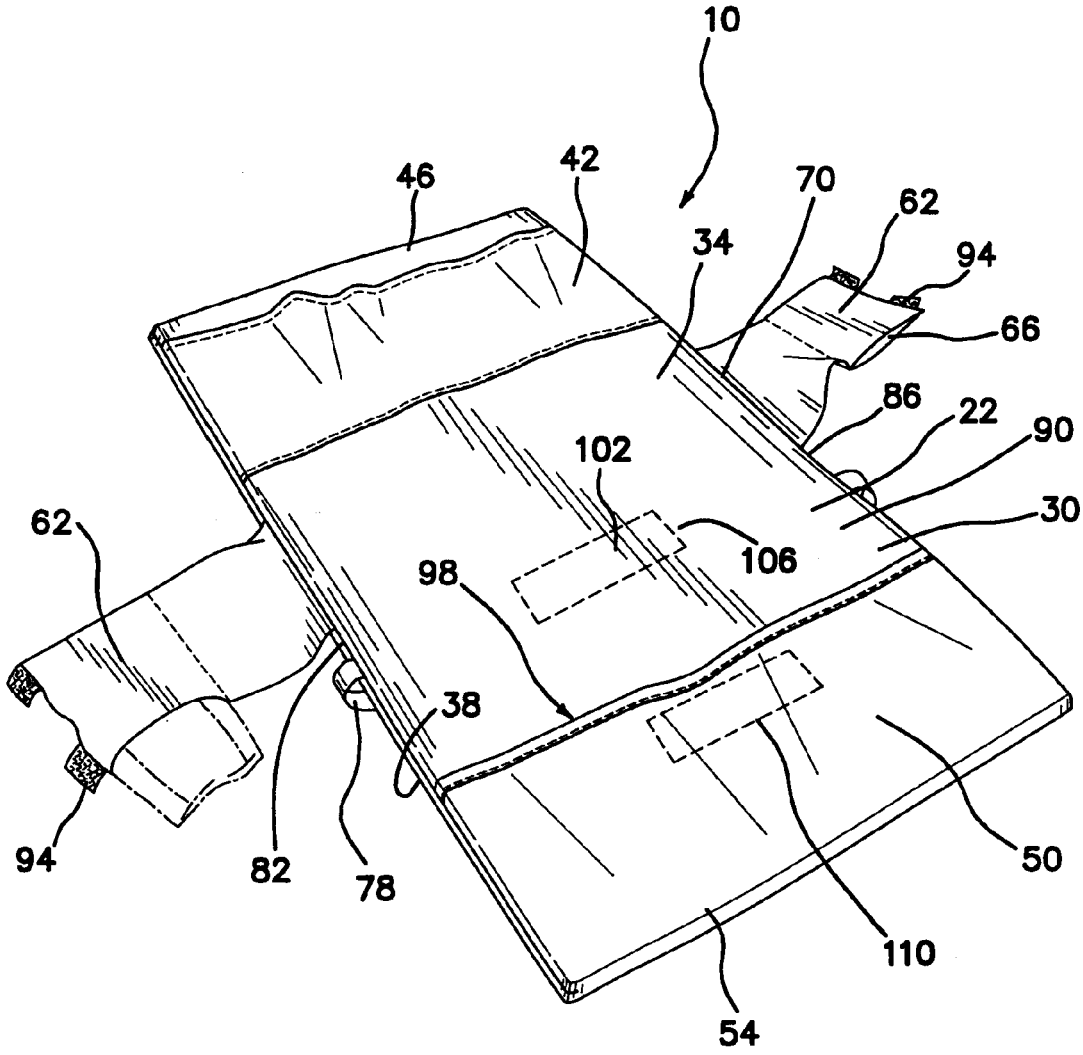
FIG. 2 is a perspective view of the FIG. 1 embodiment with the center pockets folded outwardly.
Figure 3:
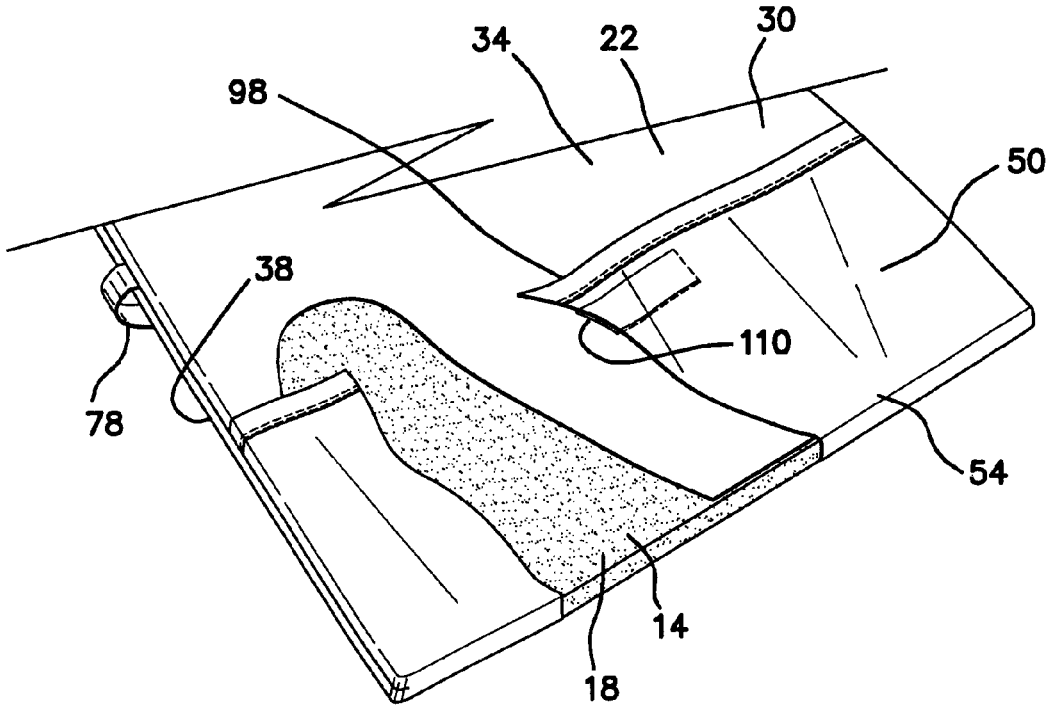
FIG. 3 is a partial perspective view of the FIG. 1 embodiment cutaway to illustrate the foam core, the washable cover and retaining sleeve.
Figure 4:
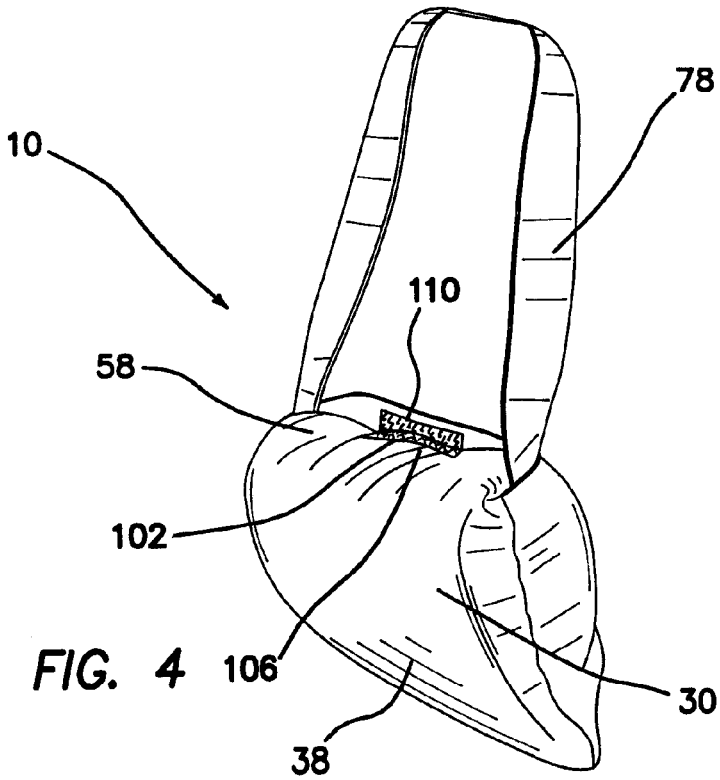
FIG. 4 is a perspective view of the FIG. 1 embodiment illustrating the duffel in stowed configuration.
Figure 5:
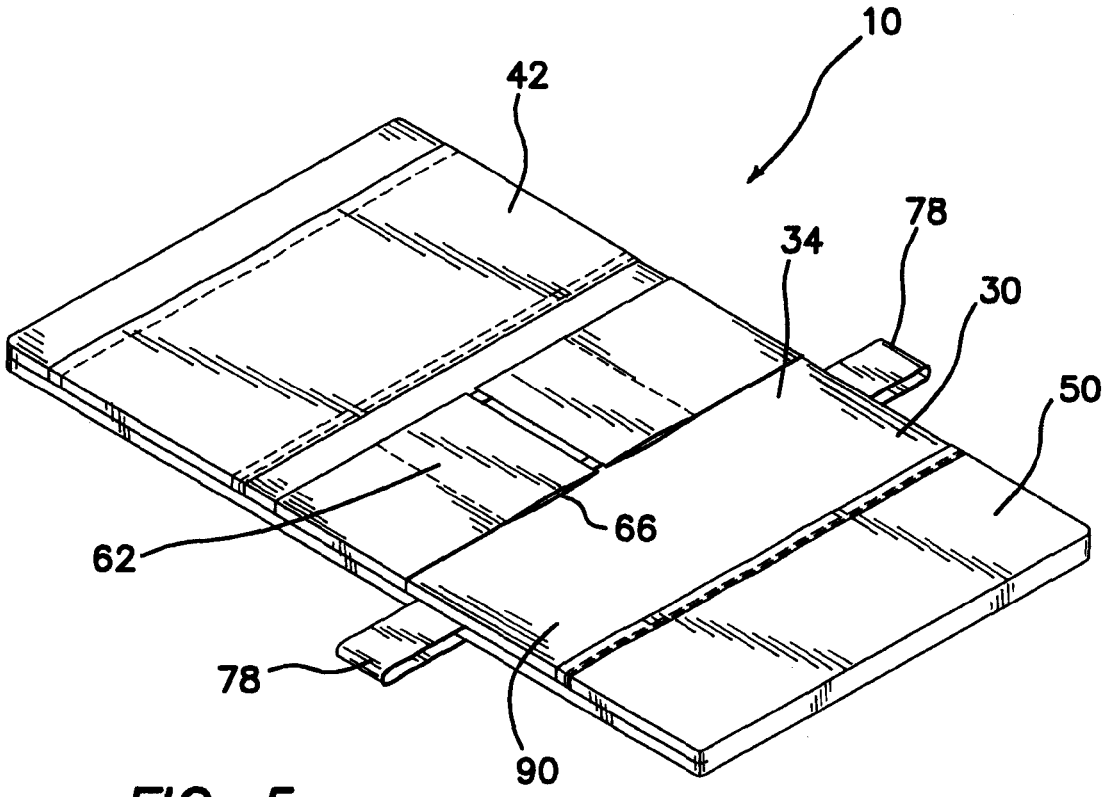
FIG. 5 is a perspective view of the FIG. 1 embodiment illustrating the assembly stitching of the duffel.
Figure 6:
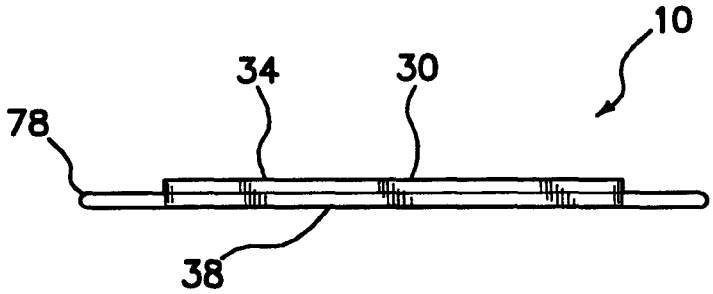
FIG. 6 is an end elevational view of the FIG. 1 embodiment.
Figure 7:
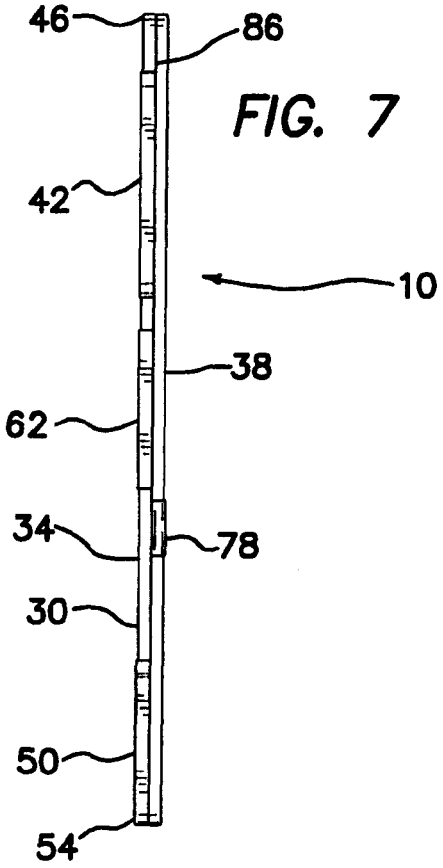
FIG. 7 is a side elevational view of the FIG. 1 embodiment.
Figure 8:
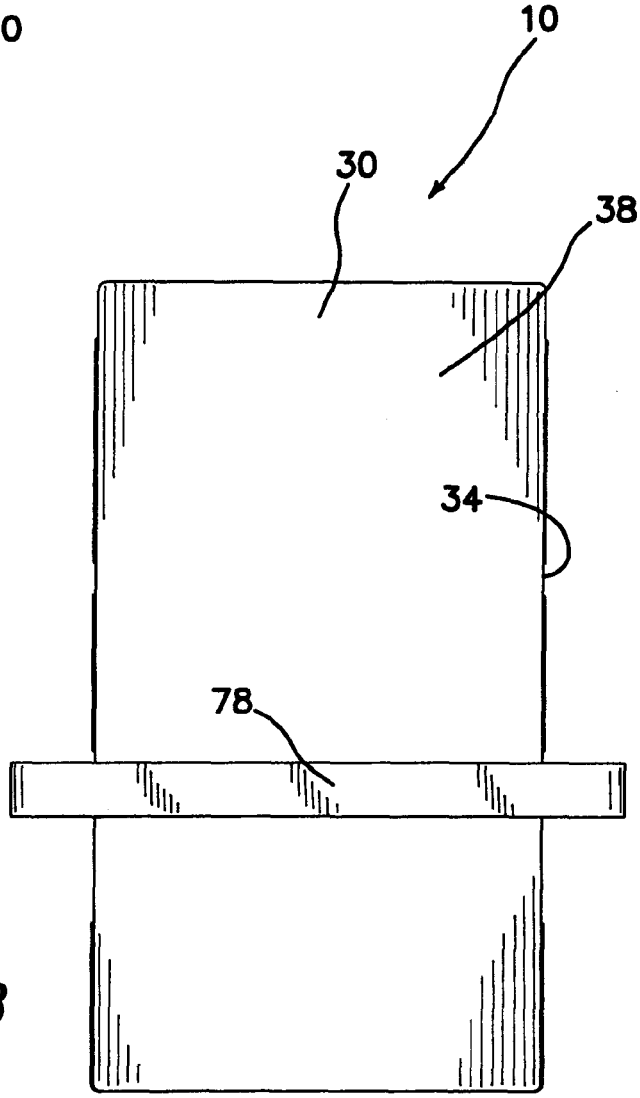
FIG. 8 is a bottom view of the FIG. 1 embodiment.

(2) In a variant of the invention, the inner changing surface 34 is formed of waterproof material 90.

(3) In another variant, hooking and looping pads 94 are attached to the side pocket 62 to secure the pocket 62 to either the inner changing surface 34 or another side pocket 62.

(4) In still another variant, the retaining sleeve pouch 50 provides a covered opening 98 for removing the washable cover 30 from the changing pad 14.

(5) In a final variant of the invention, as illustrated in FIG. 1, hooking and looping elements 102 are added to a central portion 106 of the outer surface 38 of the cover 30 and an inner portion 110 of the retaining sleeve 50. The looping and hooking elements 102 secure the central portion 106 within the retaining sleeve 50.

The baby changing duffel 10 has been described with reference to particular embodiments. Other modifications and enhancements can be made without departing from the spirit and scope of the claims that follow.

The invention claimed is:

1. A baby changing duffel, comprising:

a changing pad, having a top surface, a bottom surface, an upper edge surface, two side edge surfaces, and a lower edge surface, said pad being formed of resilient material, sized and shaped to serve as a changing surface for either of an infant and a toddler;

a removable, washable cover, said cover being sized and shaped to fit over the top surface, the bottom surface, the upper edge surface, and the two side edge surfaces of said changing pad and having an inner changing surface and an outer surface, said inner changing surface extends to but does not fit over said lower edge surface of said changing pad;

an upper storage pouch, said upper pouch attached adjacent to an upper end of said outer surface;

a retaining sleeve, said retaining sleeve attached adjacent to a lower end of said outer surface, forming a pouch, said pouch having said inner changing surface as a first wall and said retaining sleeve as a second wall, and being sized and shaped to enclose a folded portion of said changing pad and washable cover;

at least one side pocket, said side pocket having at least one interior compartment and being attached at a first edge at a side edge of said outer surface of said removable cover, said side pocket being folded over said inner changing surface for transport;

a carrying handle, said handle extending from a first side edge of said cover to a second side edge of said cover and disposed to support said duffel when folded to fit said retaining sleeve;

wherein said retaining sleeve overlaps the inner changing surface providing a covered opening for removing said washable cover from said changing pad.

2. The baby changing duffel, as described in claim 1, wherein said inner changing surface is formed of waterproof material.

3. The baby changing duffel, as described in claim 1, wherein hooking and looping pads are attached to said side pocket to secure said pocket to either of said inner changing surface and another side pocket.

4. The baby changing duffel, as described in claim 1, wherein hooking and looping elements are added to a lower end of said outer surface of said cover and an inner portion of said retaining sleeve, said looping and hooking elements securing said lower end within said retaining sleeve.

* * * * *